US010240264B2

(12) United States Patent
Hall

(10) Patent No.: US 10,240,264 B2
(45) Date of Patent: Mar. 26, 2019

(54) CIRCULAR LOOM FOR CREATING A LOOPED WOVEN ARTICLE AND METHOD OF PRODUCING A LOOPED WOVEN ARTICLE

(71) Applicant: Deborah Jean Hall, Hatfield, PA (US)

(72) Inventor: Deborah Jean Hall, Hatfield, PA (US)

( * ) Notice: Subject to any disclaimer, the term of this patent is extended or adjusted under 35 U.S.C. 154(b) by 317 days.

(21) Appl. No.: 15/171,289

(22) Filed: Jun. 2, 2016

(65) Prior Publication Data

US 2016/0355955 A1 Dec. 8, 2016

Related U.S. Application Data

(60) Provisional application No. 62/170,046, filed on Jun. 2, 2015.

(51) Int. Cl.
*D03D 29/00* (2006.01)

(52) U.S. Cl.
CPC ..... *D03D 29/00* (2013.01)

(58) Field of Classification Search
CPC ..... D03D 29/00
See application file for complete search history.

(56) References Cited

U.S. PATENT DOCUMENTS

| | | | | |
|---|---|---|---|---|
| 760,919 | A | 5/1904 | Poole | |
| 1,508,818 | A | 9/1924 | Poida | |
| 2,043,082 | A | 6/1936 | Wallach | |
| 2,601,222 | A | 6/1952 | Wehrli | |
| 2,707,316 | A | 5/1955 | Doniger | |
| 2,723,439 | A | 11/1955 | Doniger | |
| 2,802,255 | A | 8/1957 | Wallach | |
| 3,724,041 | A | 4/1973 | Cleverley | |
| 3,996,969 | A | 12/1976 | McCullough et al. | |
| 6,719,013 | B1 | 4/2004 | D'Estais | |
| 7,147,008 | B2 | 12/2006 | Sayler | |
| 7,677,273 | B2 | 3/2010 | Skaflestad | |
| 7,762,284 | B2 | 7/2010 | Ricks | |
| 2005/0247745 | A1 | 11/2005 | Spor et al. | |
| 2008/0173368 | A1 | 7/2008 | Flodin et al. | |
| 2010/0269947 | A1 | 10/2010 | Spear | |
| 2014/0166150 | A1* | 6/2014 | Teramoto | D04D 1/04 139/29 |

* cited by examiner

*Primary Examiner* — Andrew W Sutton
(74) *Attorney, Agent, or Firm* — Cusick IP, PLLC; Clinton J. Cusick, Esq.

(57) ABSTRACT

A circular loom is provided for constructing a looped woven article with integrated warp elements; a method of constructing a looped woven article utilizing a circular loom.

20 Claims, 11 Drawing Sheets

CIRCULAR LOOM FOR CREATING A LOOPED WOVEN ARTICLE AND METHOD OF PRODUCING A LOOPED WOVEN ARTICLE

RELATED CASES

This application claims priority to U.S. Provisional Patent Application No. 62/170,046 filed Jun. 2, 2015, which is incorporated herein by reference in its entirety.

BACKGROUND OF THE INVENTION

Field of the Invention

The present general inventive concept is directed to an apparatus for constructing a woven article and a method of constructing a looped woven article. A method for producing circular beadwork is disclosed.

Description of the Related Art

Looms for weaving and for bead weaving have been employed for thousands of years. Looms in practice require warp and weft threads to achieve weaving. It is a common artifact of the process that woven articles are left with fringe or remnants of the warp threads. For example on rugs, the warp threads may be grouped and tied into tassels for decorative effect. For a woven bracelet, the warp threads may be grouped and tied together on each side of the woven product. The bracelet can be formed by further binding the two grouped sides together to form a loop. This tying up of loose warp threads can be visually unattractive. It requires that the decorative and appealing woven section of the article be truncated and a portion of the article is composed only of grouped warp threads instead of the decorative woven pattern.

What is needed is a device and method for making a woven article that does not employ extraneous warp threads. A device that allows weaving without the use of warp threads extending beyond the woven article can produce an article composed entirely, or nearly entirely, of decorative woven materials, and is therefore visually attractive along the entire length of the woven article. A device that provides a woven article in a loop without extraneous warp threads can produce a more visually attractive article that is finished without the need to tie up or address warp threads.

SUMMARY OF THE INVENTION

It is an aspect of the present invention to provide a circular loom for producing a woven article in a loop. The above aspects can be obtained by a circular loom comprising a first end member and a second end member separated by at least one strut and retained by a tensioning member interacting with a retaining means on each end member; the first end member and second end member comprising a smooth outer surface suited for slidable rotation of a looped article around the outer surfaces of the circular loom and slidable lateral positioning of warp elements and slidable removal of the finished article from the loom.

Another embodiment is provided where a fixed dimension circular loom is provided, and another embodiment is provided where adjustable means are provided to move a first end member relative a second end member in order to provide a circular loom with different outer circumference configurations.

A method of constructing a looped woven article is provided using a circular loom in an embodiment of the invention including establishing a plurality of warp loops around a first end member and a second end member; weaving a decorative item to the plurality of warp loops by passing a weft thread through said decorative item and behind the plurality of warp loops passing around the end warp and passing back through said decorative item above said plurality of warp loops; weaving additional decorative items to the warp loops, and slidably removing the looped woven article from the circular loom.

It is a further aspect of the invention to provide a kit comprising a variety of strut lengths configured to space the first end member and second end member by a corresponding distance in order to construct a looped woven article of a desired circumference or produce circular beadwork. Kits are provided to assemble a circular loom having a range of exterior circumferences when assembled.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which.

DESCRIPTION OF THE PREFERRED EMBODIMENTS

Figure 1A:
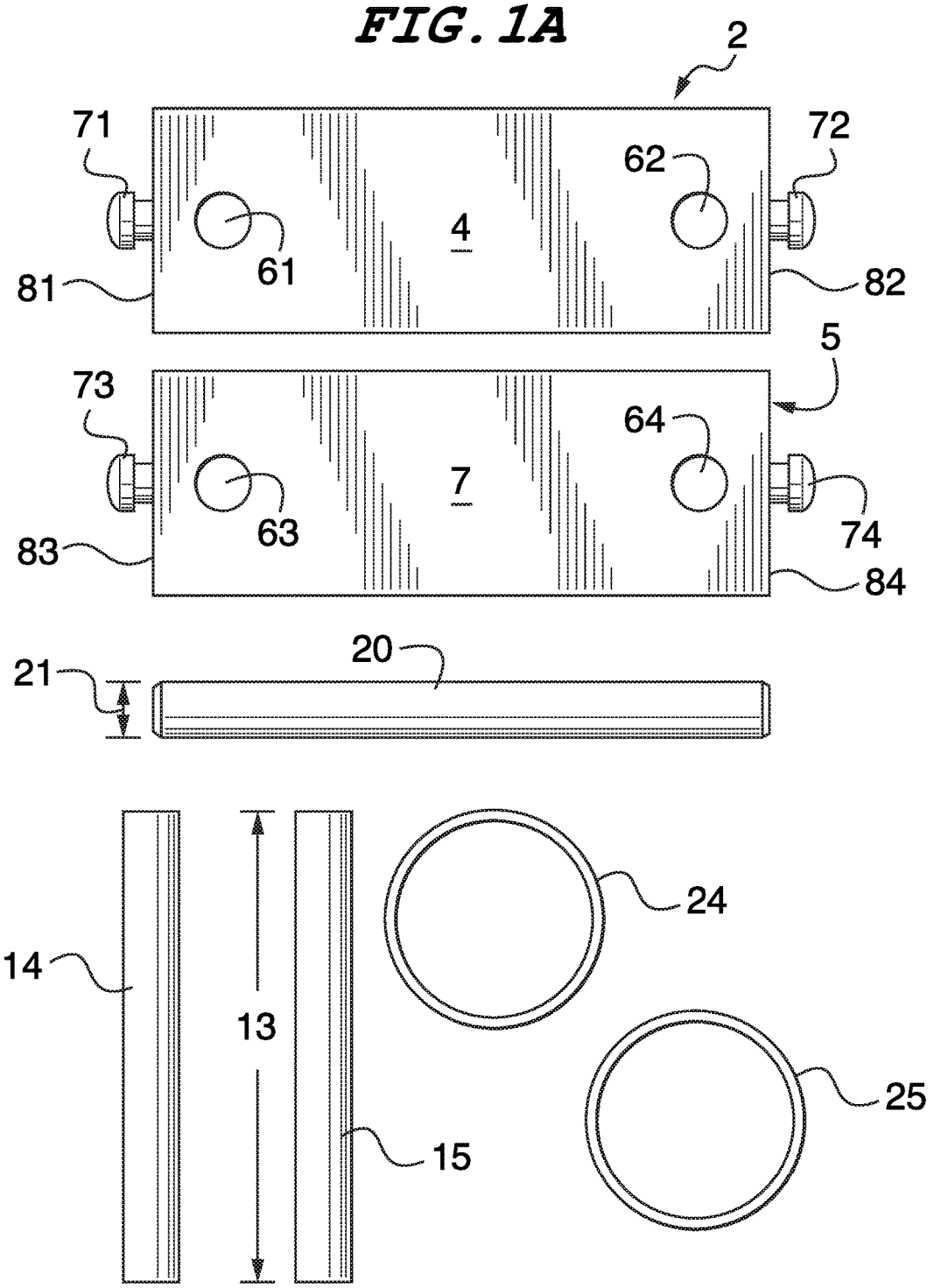
FIG. 1A is a front view of a kit in an embodiment of the invention.

Reference will now be made in detail to the presently preferred embodiments of the invention, examples of which are illustrated in the accompanying drawings, wherein like reference numerals refer to like elements throughout.

The present inventive concept relates to an apparatus for constructing a woven article without the need for extraneous warp threads of a conventional loom. The novel device allows for individual members such as beads to provide spacing between flexible filaments to provide the structure for producing a woven article. Elastic warp elements such as circular warp bands can also be employed to provide spacing. The following description of the figures will present the device and disclose a method of using the device to produce a woven article.

FIG. 1A presents the elements of a circular loom embodiment in a deconstructed configuration. The device can be provided as a kit for assembly by the user. First end member 2 is shown with first recess 61 and second recess 62 disposed on first inner surface 4. Similarly, second end member 5 is shown with third recess 63 and fourth recess 64 on second inner surface 7. End member 2 can be provided with a circular cross section or having an elliptical or oval shaped cross section. End member 2 is suited for engagement of warp loops, not shown. First strut 14 is shown with second strut 15 and each preferably presented with the same strut length 13. First end member 2 comprises first retaining means 71 positioned on first end profile surface 81 and second retaining means 72 positioned on second end profile surface 82 shown in the embodiment as a knob and configured to retain a compression member. Second end member 5 comprises third retaining means 73 positioned on third end profile surface 83 and fourth retaining means 74 positioned on fourth end profile surface 84. First compression member 24 and second compression member 25 are interchangeable and can be any material that engages a retaining means on each end member to hold the device together. First compression member 24 can be an elastic band, an elastic loop, or any expandable loop that provides compression. For ease of use, materials such as latex, rubber, silicone or other elastic materials can be most conveniently applied to the retaining means, however nonelastic materials, such as thread or cord, can be looped and tied to retain the end members 2, 5 in position. Recess 61 is preferably formed with a recess depth equal to the depth of the other three recesses. In this way, first inner surface 4 and second inner surface 7 are spaced apart by a distance dictated by the strut length 13 and the recess depth. If strut 15 has a strut length 13 of three inches and each of the recesses are ¼ inch deep, first inner surface 4 and second inner surface 5 will be spaced apart by 2.5 inches when assembled, see FIG. 2. Struts 14 and 15 can be provided at different lengths to dictate different sizes of woven articles. In one embodiment of the invention, end members are spaced apart by a pair of struts each having equal lengths. Here, struts 14, 15 are provided as a pair and each have strut length 13. Spacer 20 is shown with spacer width 21. Other spacer widths can be employed as needed. Spacer 20 can provide easement to a woven article constructed on a circular loom. Spacer 20 can also be used to create additional tautness in the warp threads to facilitate the weaving process. Spacer 20 can be configured to provide slidable engagement with outer surface 3 or outer surface 5. Spacer 20 can be generally cylindrical in shape so that it can slide along the outer surface or rotatably roll along the outer surface. Spacer 20 is preferably smooth and can provide slidable engagement without creating a snag or binding with an outer surface.

Figure 1B:
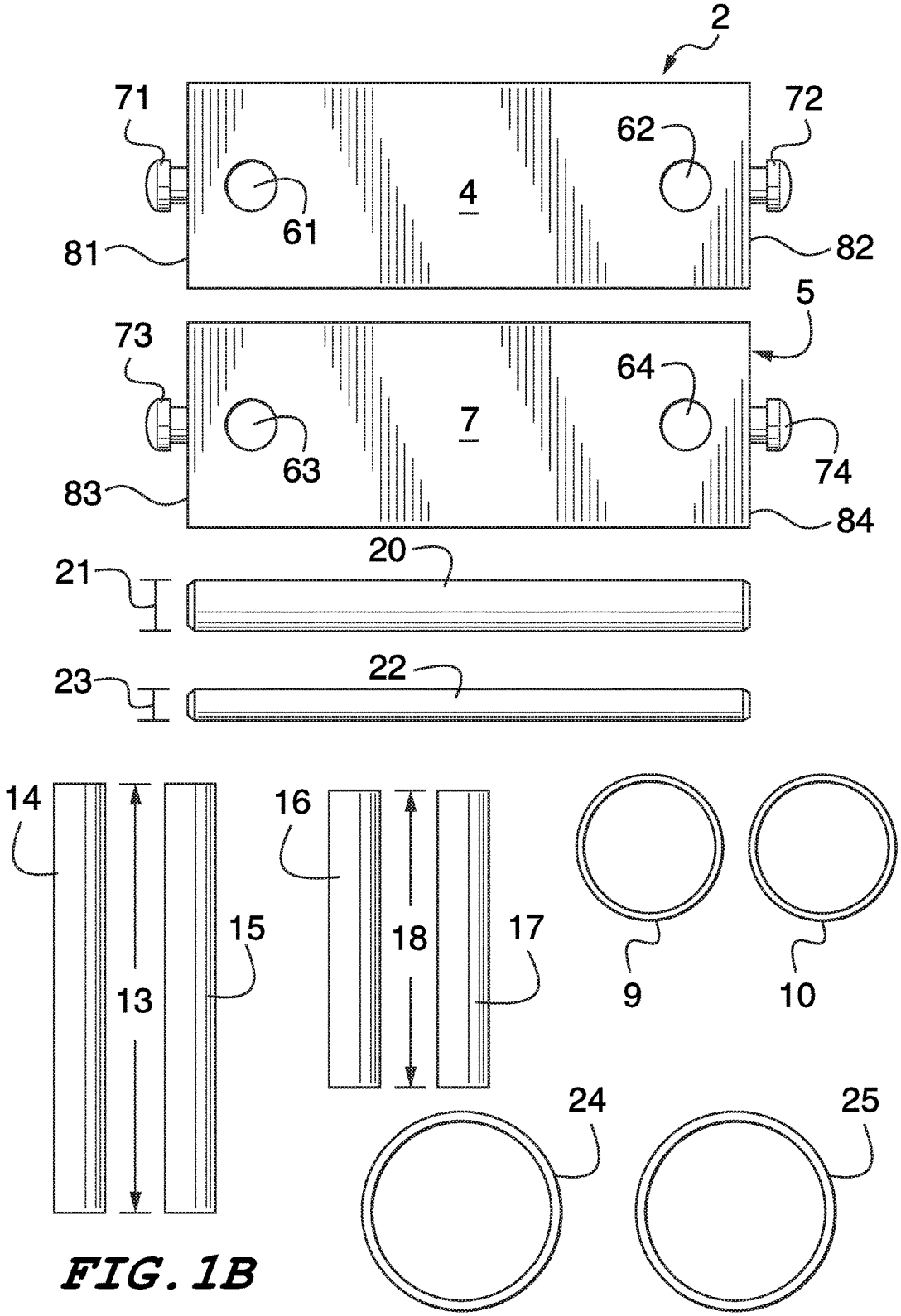
FIG. 1B is a front view of a kit in an embodiment of the invention.

FIG. 1B presents a front view of a kit for assembling a circular loom in an embodiment of the invention. Multiple struts can be provided to produce a circular loom having various dimensions. Two sets of struts are provided, but it is understood that any practical number of struts comprising a plurality of struts can be provided to space first end member 2 and second end member 5 apart to provide a circular loom of various dimensions. Struts 14 and 15 are shown with strut lengths 13. Short struts 16 and 17 are shown with short strut length 18. Retaining means 24, 25 can be provided in various lengths with a reduced circumference or increased circumference to provide tension between the end members 2, 5 when spaced by struts that are shorter or longer in various embodiments of the invention. First spacer retaining means 9 and second spacer retaining means 10 can be elastic bands or loops of material with elasticity or provide a friction drag to retain a spacer 20 or reduced spacer 22. A kit can be provided with a number of pairs of struts and a pair of end members. The struts can be provided in lengths that when combined with a pair of end members, provide a circular loom with a known circumference, configured to produce a circular woven article of a corresponding circumference. Spacer 20 can be provided with spacer width 21. Reduced spacer 21 can be provided with reduced spacer width 23. The parts of the kit can be used to produce woven articles of different sizes. In another embodiment, the kit can provide one set of struts and end members as well as tensioning means and be configured to produce woven articles of a consistent circumference. In one embodiment, a kit can be provided comprising a pair of end members, three pairs of spacers of varying widths, six pairs of struts configured to produce a looped woven article having a circumference of five to nine inches and intermediate sizes there between, and non-latex elastic bands. A case for storage of the above components and additional storage for tools can be provided as part of the kit.

Alternate strut configurations can be utilized. Wooden dowels are common and simple to produce, however a single strut having an oblong or rectangular cross section can be utilized. A single recess on first end member in the shape of a rectangle can correspond to a second recess on second end member, and the length of the recesses can correspond to the cross section of an elongated strut. The elongated strut can be of sufficient size to provide stability to the circular loom and prevent wobbling. A circular loom can be employed with a single strut. The presence of a strut in the middle of the circular loom can interfere with weaving, and so two struts spaced apart from the center of the loom is desirable and provides stability. Strut pairs can be provided in different lengths, and single wide struts can be provided in a kit, and any configuration of a strut can be provided in a variety of lengths to space end members apart as needed to produce different sized articles.

Figure 2:
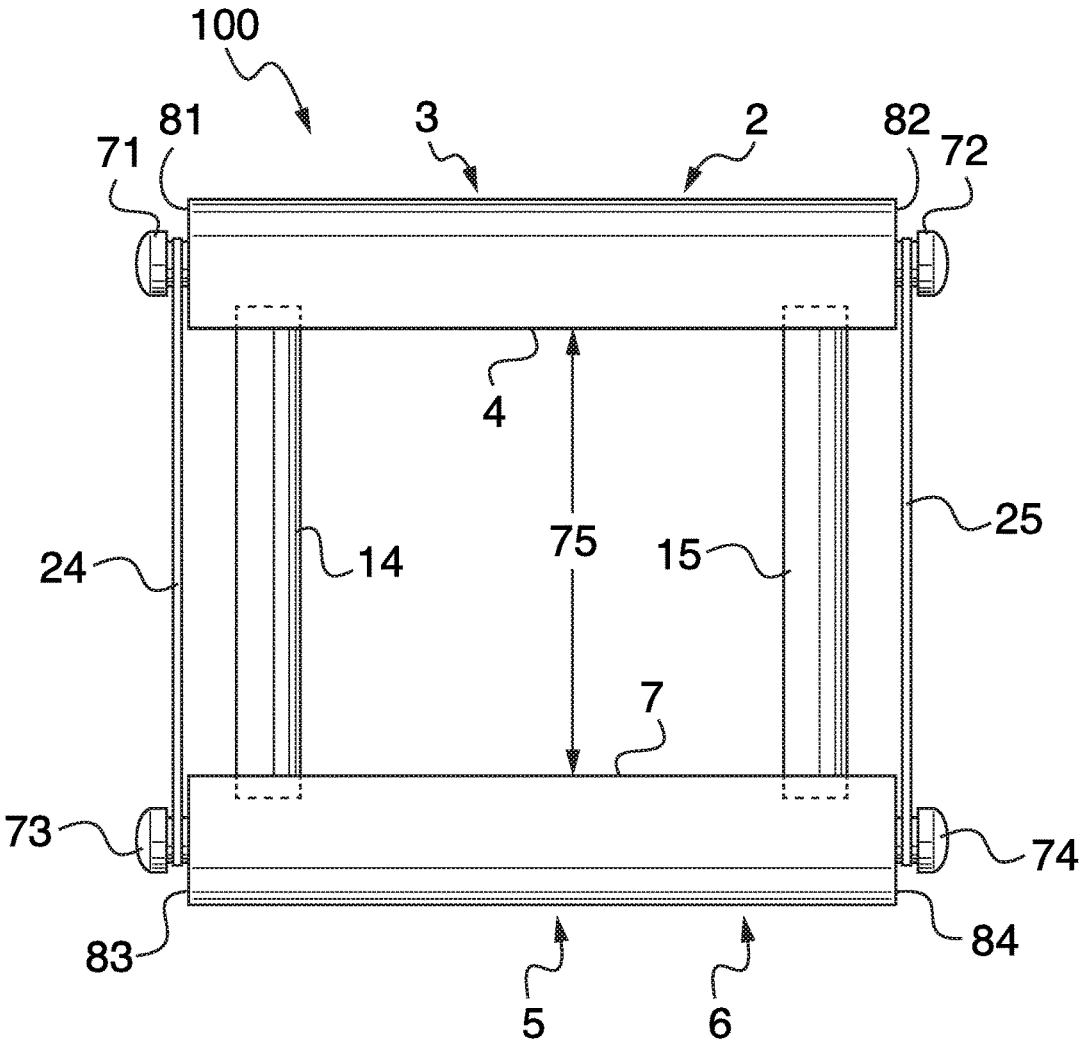
FIG. 2 is a front view of a circular loom in an embodiment of the invention.

FIG. 2 presents a front view of an embodiment of the invention in an assembled configuration. An embodiment of circular loom 100 is shown. First strut 14 is shown as spacing apart first end member 2 and second end member 5. First inner surface 4 and second inner surface 7 are spaced apart as dictated by strut length 13 less the cumulative recess depth described in FIG. 1. First compression member 24 engages retaining means 71 and 73 and tensions first end member 2 towards second end member 5 to keep the circular loom 100 assembled. Second compression member 25 engages retaining means 72 and 74 to tension the elements together. Inner spacing 75 is shown as the distance between first inner surface 4 and second inner surface 7. First outer surface 3 is preferably smooth and allows a woven article to be slidably removed off of the loom 100. Second outer surface 6 is preferably smooth and allows a woven article to be slidably removed off of the loom 100. Additionally the smooth outer surfaces 3, 6 provide for rotation of looped woven article around the end members 2, 5 so that the woven article can be accessed as needed between the end members. The smooth outer surfaces are shown to have the cross section of a semicircle. Smooth outer surfaces can be provided in a number of shapes that provide for easy rotation of a woven article, finished or in process, about the end members 2, 5 of the circular loom. Oval, elliptical, and circular outer surfaces can be provided. In this way, the decorative elements can be added between the end members and the open work space in the center of the circular loom can be utilized consistently and the woven article can be rotated about the circular loom as needed. The woven article can be slidably rotated about the circular loom. Another benefit of the device of the invention is that a woven article can be slidably removed from the circular loom. Conventional looms require that the warp threads are bound and retained to provide tension and therefore removal of a woven article requires a lengthy removal process and further necessitates that the loose warp threads be bound or otherwise addressed. As shown in Figures, for example FIG. 7, the looped woven article can be quickly and easily slidably removed from the circular loom.

Additional configurations will be apparent to one skilled in the art. Alternative to recesses placed on the inner surface of the end member, struts can intersect the end member perpendicular to the inner spacing 75. Struts can be used to attach first end member 2 and second end member to a stable structure such as a conventional loom or any structure having a corresponding recess for a dowel or other shape of a strut. The embodiment shown in the kit of FIGS. 1A and 1B is complete and does not require additional material to be constructed. However, for users that have a work bench, frame, or a loom, an embodiment can be provided where posts can intersect the end members in lieu struts 14, 15. A post can be inserted into first end member 2 to provide stability and a second post can be inserted into second end member 5 to provide stability and inner spacing 75 between the two end members. End members can be intersected in the x, y, or z axis to retain the position of the end members for construction of a woven article. One convenient configuration is provided in FIG. 2 where the struts provide inner spacing 75 and retaining means 24, 25 provides tension to keep the parts of the circular loom 100 together. In another embodiment post recess can be provided in first outer surface 3 and second outer surface 6, perpendicular to the struts shown in FIG. 2, so that the end members can receive posts that further intersect a work table, loom, frame, or work surface and retain the end members with fixed spacing and parallel to each other. A post can interact with an end member and an external device such as a frame. A strut can intersect a recess on a first end member and a second end member. It will be understood that cylindrical elements such as dowels can be utilized as both posts as well as struts, and a kit can be provided where end members comprise post recesses so that the end members can be releasably attached to a frame. If it desired to place the circular loom next to a support frame, post recesses can be inserted into end members 2, 5 parallel to the length of the respective end member. If it is desired to place the circular loom above a work surface or support frame, post recesses can be disposed in end members 2, 5 perpendicular to the long axis of the end member. Spacing the end members apart by a fixed width or variable with can be accomplished with struts or posts. A kit utilizing struts as shown in FIG. 2 does not require an external frame or surface and can be sold as a complete solution that does not require any additional device or parts.

Figure 3:
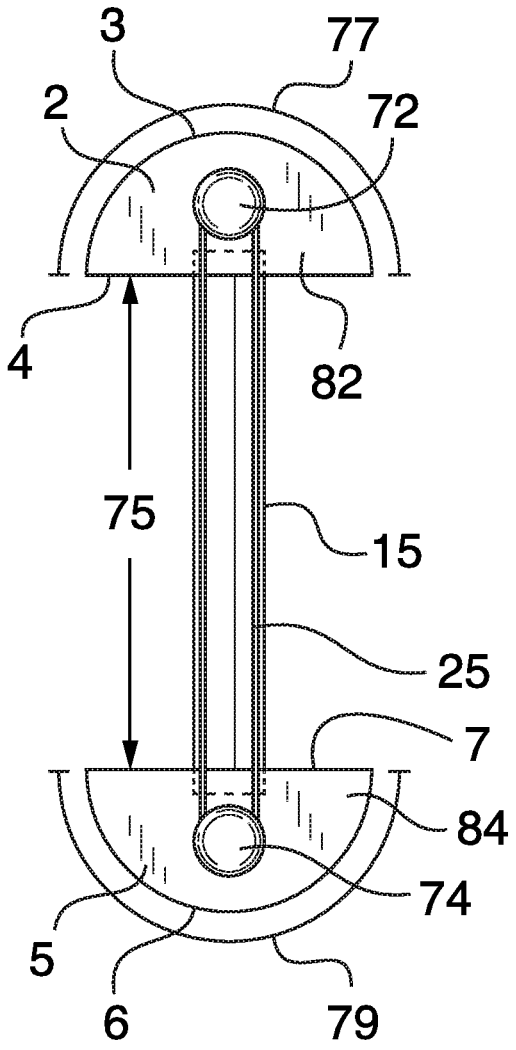
FIG. 3 is a side view of a circular loom in an embodiment of the invention.

FIG. 3 presents an end view of the embodiment shown in FIG. 2. First outer surface 3 has first perimeter 77. Second outer surface 6 has second perimeter 79. The outer surfaces are preferably smooth to allow for items to be slidably rotated around the circumference of the device or slidably removed from the device. A thread or other flexible material passed around the exterior of the loom shown in FIG. 3 would travel a cumulative distance of first perimeter 77, second perimeter 79 and twice the distance of inner spacing 75. In this way, the size of the finished article can be estimated. Slidable rotation of warp elements and decorative items about the circumference of the circular loom is provided by smooth outer surface 3 and smooth outer surface 6. Smooth outer surface 3 and smooth outer surface 6 are configured to provide continuous lateral positioning and slidably rotation of warp elements. Warp elements such as a warp loop or warp circle described in FIGS. 6A and 6B can be laterally positioned at any location along the length of end members 2, 5 and can be rotated around the circumference of the circular loom as shown in the end view of FIG. 3. Struts such as strut 5 can be selected of varying lengths to provide a circular loom suited to produce a circular woven article of a desired loop length. Simple, consistent geometric calculations can be performed, or the circular loom can be provided with struts marked with a resultant loop length. In an embodiment, a circular loom can be provided with recess depths of ¼ inch and a strut length 13 of four inches to provide inner spacing 75 of 3.5 inches. Further, first end member 2 and second end member 5 can each be provided with a perimeter 77, 79 of two inches, so that a loop around the exterior of the loom has a length of 7.5 inches. The struts in this embodiment, having a length of four inches, can be marked with the resultant loop length of 7.5 inches for ease of selection by a user. A kit can be provided with struts of a varying lengths in conjunction with end members having known perimeters so that the struts can be interchanged by a user to provide a circular loom having various loop lengths to produce different sized articles as desired by a user. Kits can be provided for assembling a circular loom providing an exterior circumference from five inches to nine inches. The simplicity of the circular loom allows varying lengths and configurations to be manufactured economically and a kit can be provided with varying sized end members and varying sized struts for flexibility of the desired application. Various elements in a kit can be provided to assemble a loom having an exterior circumference range of at least two inches as measured around the perimeter of the end members 2, 5 and including the inner spacing 75.

The device of the invention can be used to produce beadwork without extraneous warp threads. In one embodiment of the method of the invention, beads can be used to produce thread spacing for consistent bead weaving that results in a looped finished article. This is particularly advantageous when producing a bracelet or similar adornment where consistent, attractive design elements are desired across the entire length of the article.

Beads have a bead thickness measured by the distance from the perimeter of the hole to the outermost edges of the bead known as the bead wall. When weaving an article comprising beads, the circular loom of the present invention benefits from the compensation of bead thickness to ensure that the article maintains the desired interior size. A spacer 20 or alternately a pair of reduced spacer 21 or spacers of other sizes (not shown) can be used to establish an elongated loop distance in utilizing the circular loom.

Figure 4:
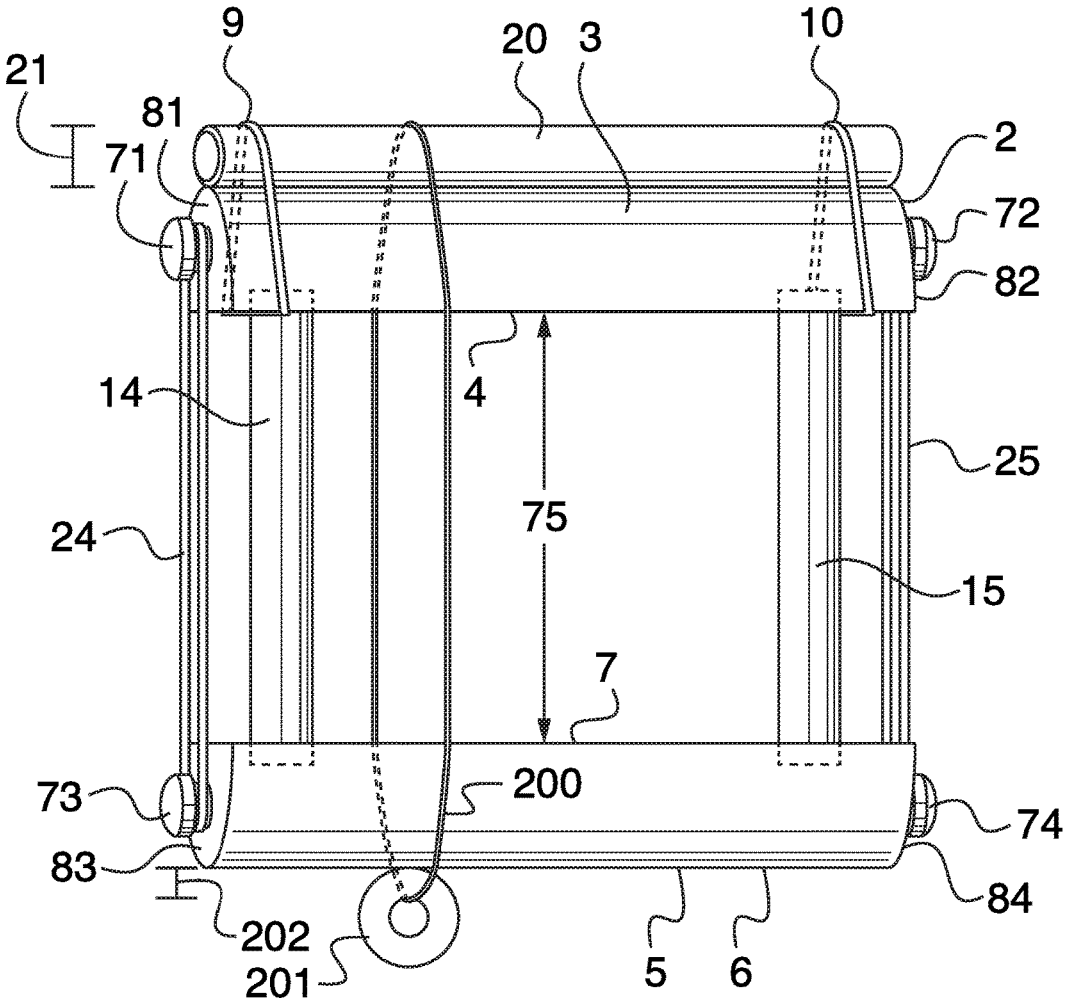
FIG. 4 is a front view of a circular loom comprising a spacer in an embodiment of the invention.

FIG. 4 presents a front view of an embodiment of the circular loom comprising a spacer bar. In this embodiment, the spacer 20 has a width 21 of twice the width of a bead wall 202 as in exemplary bead 201. Exemplary bead 201 is shown adjacent second outer surface 6 and exemplary warp loop 200 is shown passing through exemplary bead 201. Exemplary warp loop 200 and exemplary bead 201 are presented for illustration purposes to highlight the function of spacer 20. Because of the bead wall 202 thickness, exemplary warp loop thread 200 is spaced apart from second outer surface 6. As the bead work is formed and extends around first end member 2, the path traveled by warp loops, not shown, are spaced apart from outer surface 3 by a distance equal to the bead wall 202. As the bead work is completed and extends completely around the circular loom, warp loops are spaced apart from the second outer surface 6 as well. As the bead wall 202 spaces the warp loops away from the outer surfaces, the spacer 20 can be slidably removed from the interior of the warp loops. In this way, bead wall 202 thickness can be compensated to produce a looped article with a true interior circumference as selected by setting up the circular loom. Spacer 20 provides easement to the warp loops when it is removed. Additionally spacer 20 can be removed and replaced with a smaller width spacer, such as reduced spacer 22 shown in FIG. 2. As beads space a warp loop away from end member 2, easement can be provided by switching spacer 20 with reduced spacer 22. Reduced spacer 22 can be half the width of spacer 20 providing reduced spacer width 23 that is half the width of spacer width 21. As beads are added around the circular loom, reduced spacer 22 can be removed to provide further easement to warp loops.

First spacer retaining means 9 and second spacer retaining means 10 can retain spacer 20 in a desired position. Referring to FIG. 1B, first spacer retaining means 9 second spacer retaining means 10 can be provided by an element identical or similar to first compression member 24, or an elastic band or rubber band, or other suitable material that provides compression or friction to retain spacer 20 or reduced spacer 22 in place.

Figure 5:
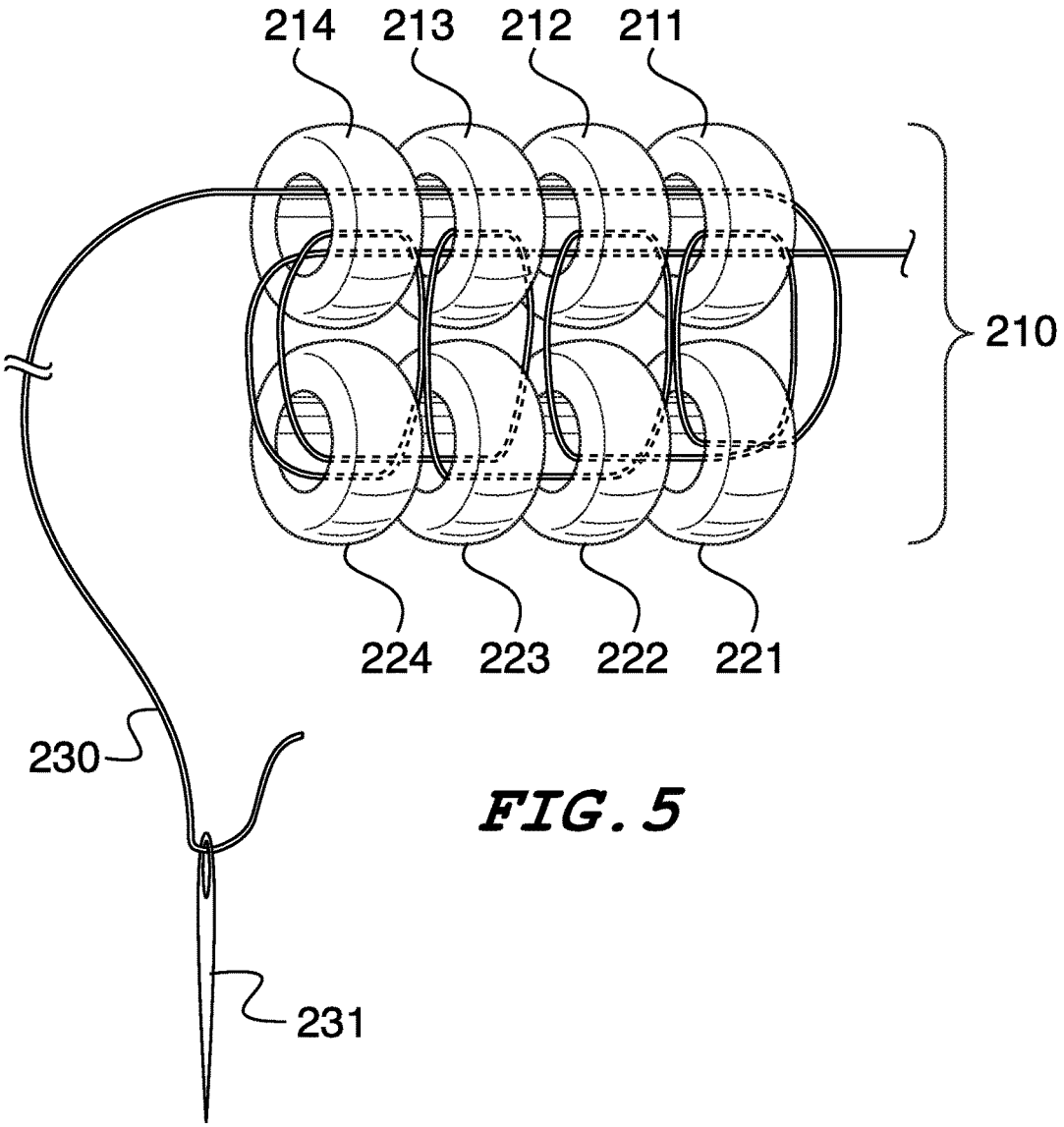
FIG. 5 is a perspective view of an embodiment of a warp foundation bead unit.

FIG. 5 presents a perspective view of a warp foundation bead unit. Any number of beads can be employed with the circular loom. For simplicity, an article having four beads across is illustrated. Two rows of beads are sufficient to provide the warp foundation bead unit 210. FIG. 5 presents an exemplary method of connecting the foundation beads 211 to 214 and 221 to 224. Any path that fixes lateral movement of the beads relative to each other can be employed. Ladder stitch, herringbone, or square stitch are known in the art and can be employed to fix the warp foundation bead unit. In FIG. 5, thread 230 and needle 231 are used to pass thread 230 through beads 211 through 224 as shown. An exemplary method is to pass thread 230 through the first row of beads as shown and then engage bead 224 and loop through bead 214 before passing through bead 224 and bead 223 and then engaging bead 213, passing through bead 223 and 222, passing through bead 212, and again through bead 222. Finishing by engaging the remaining beads 221, 211, and again through 221 before again passing through the first row of beads 211 through 214 to form foundation bead unit 210 as shown. The thread path is one of many that can be utilized to bind the foundation beads together. Thread 230 is shown extending through needle 231, and sufficient length of thread 230 should be utilized to complete the warp foundation bead unit. A guideline for providing a minimum length: passing the thread 230 around the circular loom twice for each bead in a given row can provide sufficient thread length for completing the warp foundation bead unit, and establishing the warp loops, and commencing the weaving process. Additional length of thread 230 can be provided at the outset, or added as needed for completing the woven article. The warp foundation bead unit 210 can now be used to warp the loom. In another method of practicing the invention, a clasp or decorative element can be integrated between the bead rows of bead foundation unit 210.

Figure 6A:
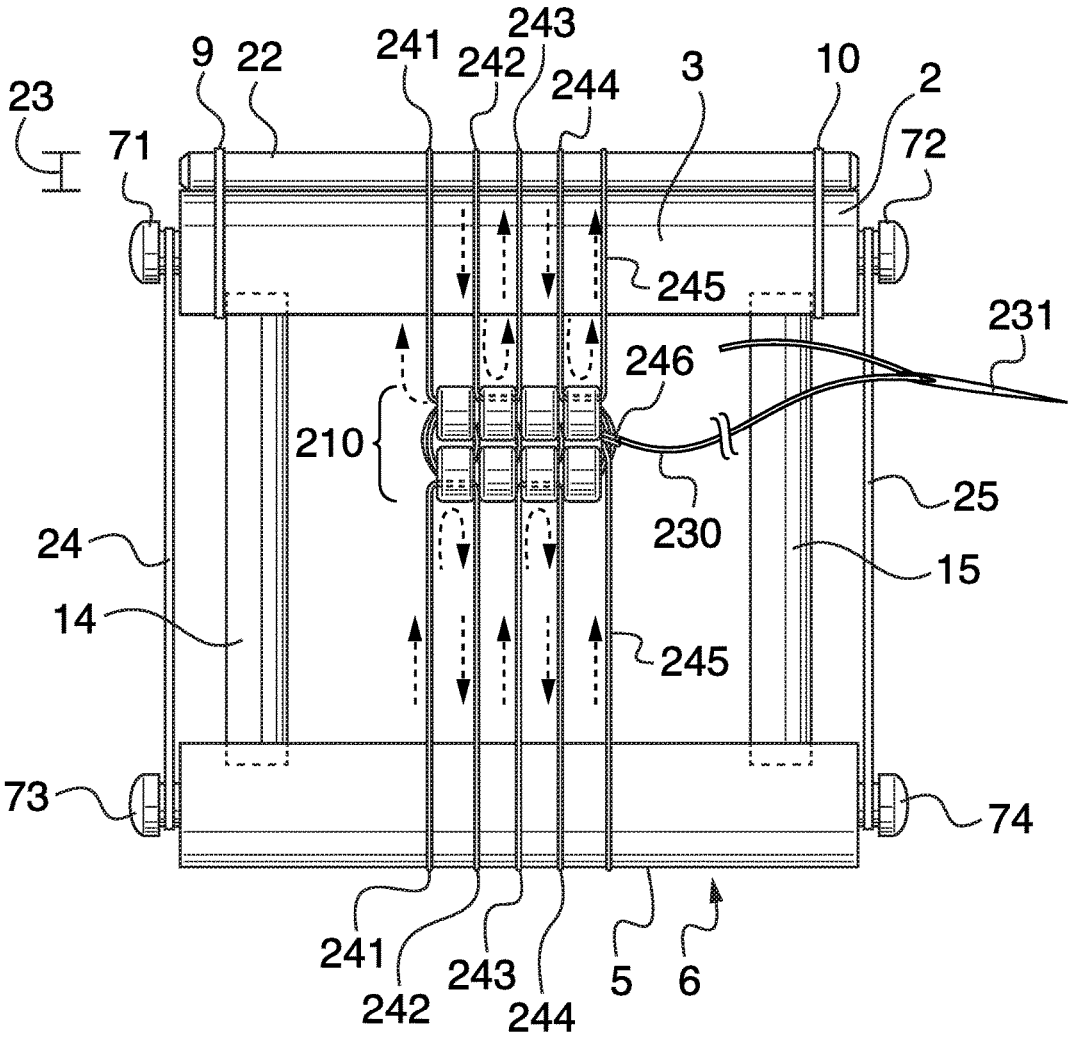
FIG. 6A is a perspective view of a circular loom comprising warp loops engaging a warp foundation bead unit in an embodiment of the invention.

FIG. 6A presents a front view of an embodiment of the circular loom of the invention and warp loops. FIG. 6A presents the warp foundation bead unit 210 and the continuation of thread 230 to provide warp loops. The individual beads are not numbered, but present the same bead elements discussed in FIG. 5 where each bead in each row is addressed utilizing the numeral shown in FIG. 5. An exemplary path is shown, but equivalent paths can be utilized that provide warp loops. Reduced spacer 22 is shown to provide easement as later needed in practicing the invention with beads. Reduced spacer 22 is shown providing additional distance between first outer surface and the warp loops 241 to 245. Reduced spacer 220 is shown as providing a space between warp loops 241 to 245 that is approximately the width of the bead wall 202 as explained in FIG. 4. Two reduced spacers 22 can be utilized in lieu of one spacer 20 or any combination of spacers as needed. Reduced spacer 22 is configured for slidable engagement between the warp loops and first outer surface 3. Reduced spacer 22 can be cylindrical in shape and can roll or slide about first outer surface 3 or second outer surface 6. Spacer 20, or reduced spacer 22 or other size spacers (not shown) can be utilized to tension warp loops 241 to 245 and provide easement to the warp loops when the spacers are removed. In a method of utilizing the circular loom, a first spacer can be removed when beadwork extends between warp loops and first outer surface, and a second spacer can be removed when beadwork extends between warp loops and second outer surface. Continuing from the description of FIG. 5, thread 230, via needle 231, is passed up over first end member 2 and reduced spacer 22 and around second end member 5 to engage bead 224 and again loop downward around second end member 5, around first end member 2, and reduced spacer 22, and engage bead 213 before traveling around first end member 2 and reduced spacer 22, and second end member 5, and engaging bead 222. Thread 230 then is passed around second end member 5 and first end member 2 and reduced spacer 22 to engage bead 211 pass again around first end member 2 and reduced spacer 22 and second end member 5 before being tied to thread 230 with knot 246 at the position shown between bead 221 and bead 211. The loom is now surrounded by warp loops including first warp loop 241, second warp loop 242, third warp loop 243, fourth warp loop 244, and fifth warp loop 245. Each of the warp loops 241 through 245 are spaced apart corresponding to a single bead. Alternately the warp loops can be spaced apart corresponding to pairs or multiples of beads. The smooth second outer surface 6 provides continuous lateral positioning of warp loops or other warp elements, and allows for infinite adjustment of warp loop position and warp loop spacing before and during the weaving process to accommodate various elements for weaving.

Figure 6B:
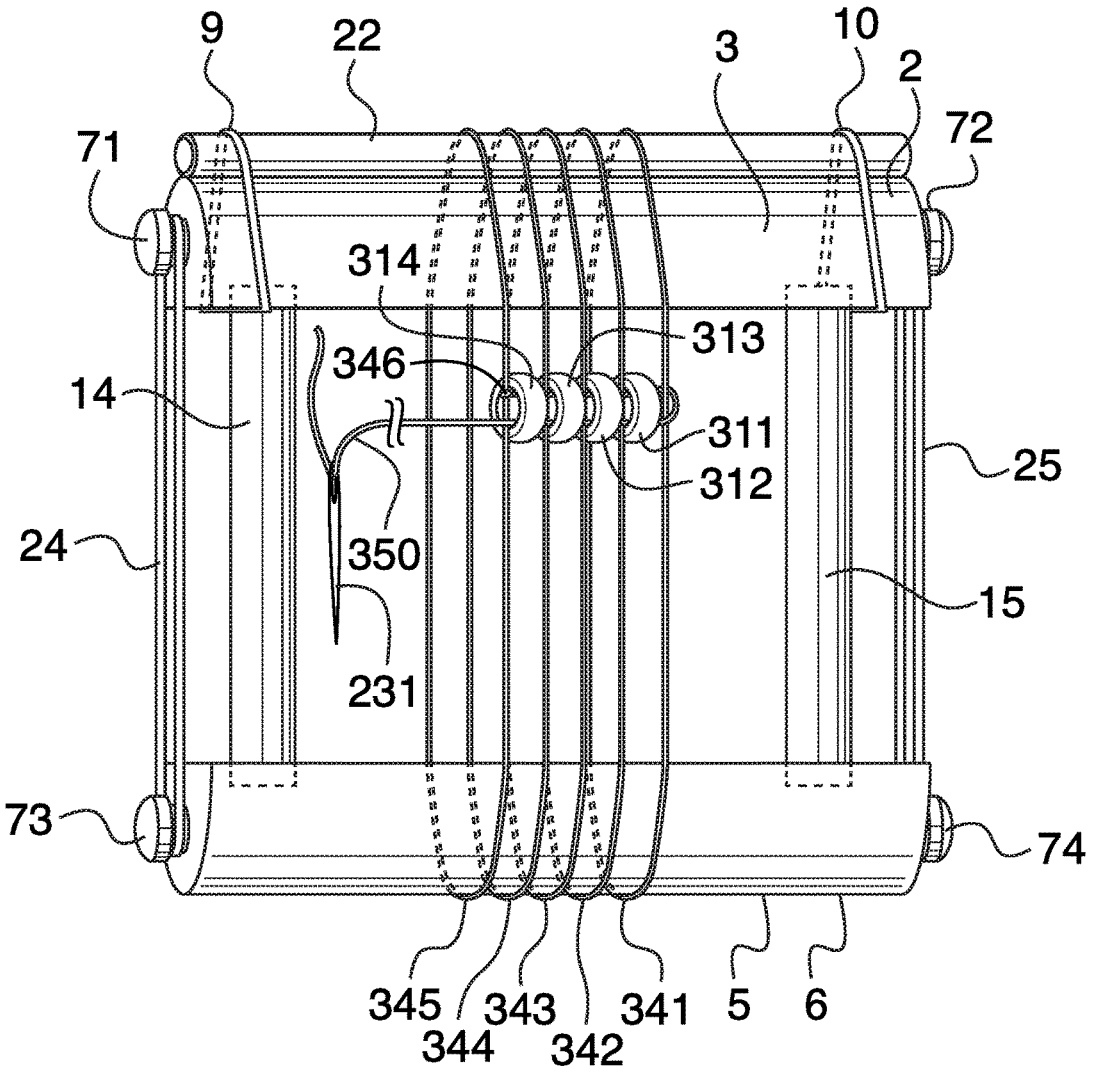
FIG. 6B is a perspective view of a circular loom comprising circular warp bands in an embodiment of the invention.

An alternate embodiment is shown in FIG. 6B where warp elements are provided by circular warp bands to form warp circles 341 through 345. Expansive warp bands can be used to produce a circular woven article that is elastic or flexible. Creating the warp elements in this method requires the use of expansive warp bands equal to the number of beads in a row, plus one. For the four beads 311 through 314 shown, five circular warp bands are shown placed intermediate each pair of beads and bordering the row of beads on each side. The result is a series of parallel warp elements, first warp circle 341, second warp circle 342, third warp circle 343, fourth warp circle 344, and fifth warp circle 345. The warp elements can be laterally positioned to establish any warp spacing needed to accommodate any decorative element geometry or bead size. End members 2, 5 are configured for continuous lateral positioning of warp elements and warp circles. End members are configured for slidable rotation of warp elements about the circumference of the circular loom. Thread 350 is then tied to an exterior warp circle, for example fifth warp circle 345 with knot 346. Thread 350, via needle 231, is then passed through the row of beads 314 through 311 behind the set of warp circles 345 to 341, around first warp circle 341 and then through the row of beads while pushed above and with a bead between each set of warp circles 345 through 341. Additional rows of beads not shown can be added by passing thread 350 through an additional row of beads twice per row, with one pass being behind or below the warp circles and the other pass being in front of or above the warp circles. As will be understood, the order of the passes above and below the warp circles can be exchanged without consequence. Additional bead rows are then added in the color or configuration desired to complete a looped woven article with no extraneous warp threads. The embodiment shown in FIG. 6B comprises elastic or expansive warp bands. These can be latex, silicone, rubber, or other known elastic or expansive materials. When provided in a circle, and added to the circular loom, they provide warp circles that are continuous and encircle the loom. Reduced spacer 22 provides easement if needed. The embodiment of FIG. 6B is different from the embodiment shown in FIG. 6A where the same element comprises the warp loops that are nearly a complete circle and also comprises the weft elements, for example thread 230.

Figure 7:
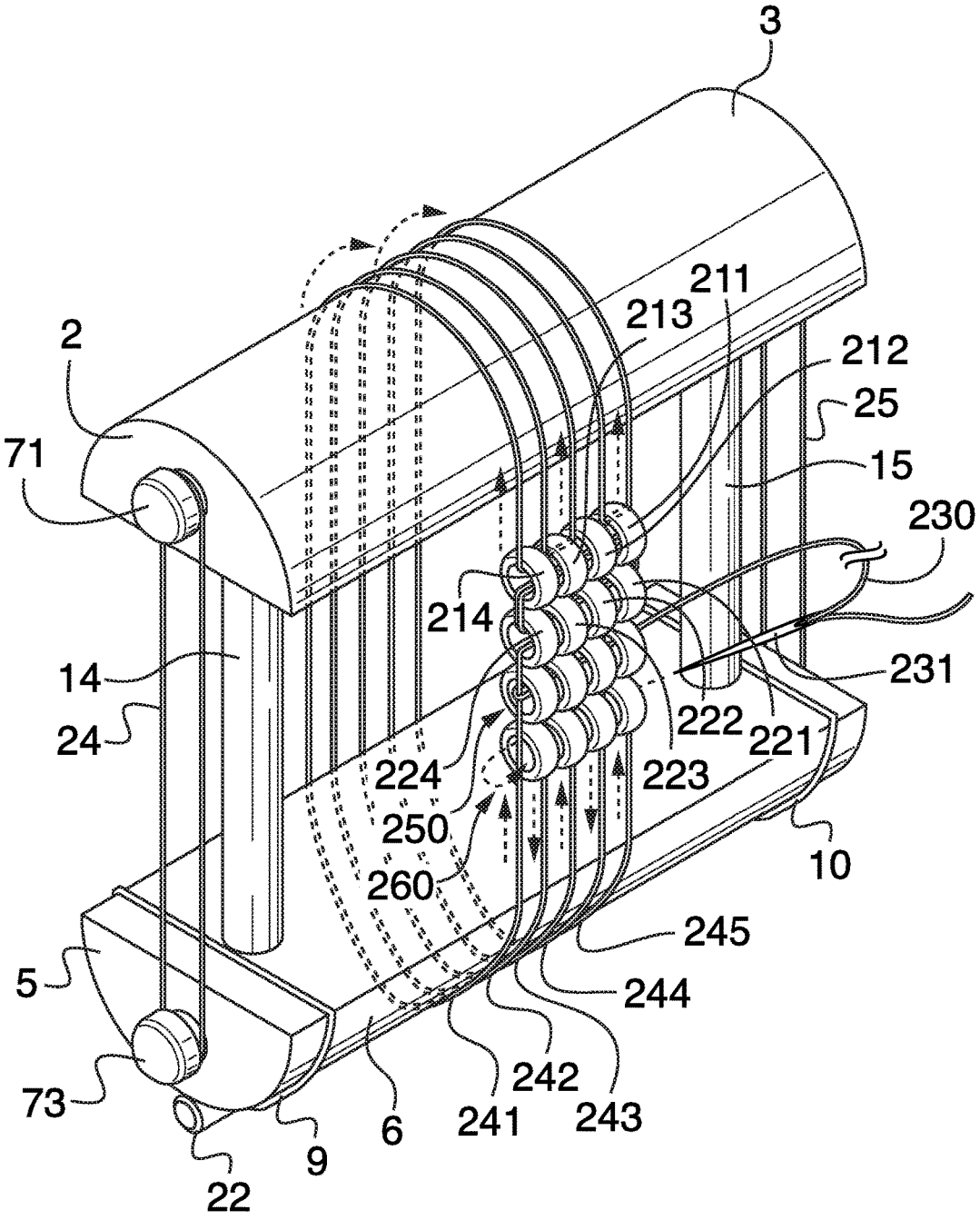
FIG. 7 is a perspective view of an embodiment of the invention featuring woven bead work.

FIG. 7 shows the bead work in process. Thread 230 can be passed through the row of beads 250, the beads 250 can be placed under the looped warp threads, and then the row of beads are pressed up between and above the looped warp threads and thread 230 is passed around the first warp loop 241 and passes back through bead row 250 again passing over the warp loops 214 to 245. One pass of the thread 230 below warp loops 241-245 and one pass of thread 230 below above warp loops 245-241 is sufficient to bind the bead row to the warp loops to produce a woven article. Thread 230 is shown making a pass around first warp loop 241. Needle 231 can be utilized to expedite the addition of bead rows. This operation can be repeated with additional bead rows such as bead row 260, until the warp loops are filled with a woven article such as bead work. The dotted line extending from the front of needle 231 shows the suggested path to weave bead row 260 into the woven article. Reduced spacer 22 can be removed or replaced as the insertion of beads onto the looped warp threads constricts the woven article on the circular loom due to the bead width as explained in FIG. 4. Spacer 20, reduced spacer 22, or no spacer can alternately employed by a user as the bead size is selected, and as the woven article completeness progresses. The completed bead work and warp elements can be slidably rotated around the circumference of the circular loom. When completed the woven article can be slidably removed from the circular loom as first outer surface 3 is smooth and second outer surface 6 is smooth and each present no obstacle to slidable removal.

Figure 8A:
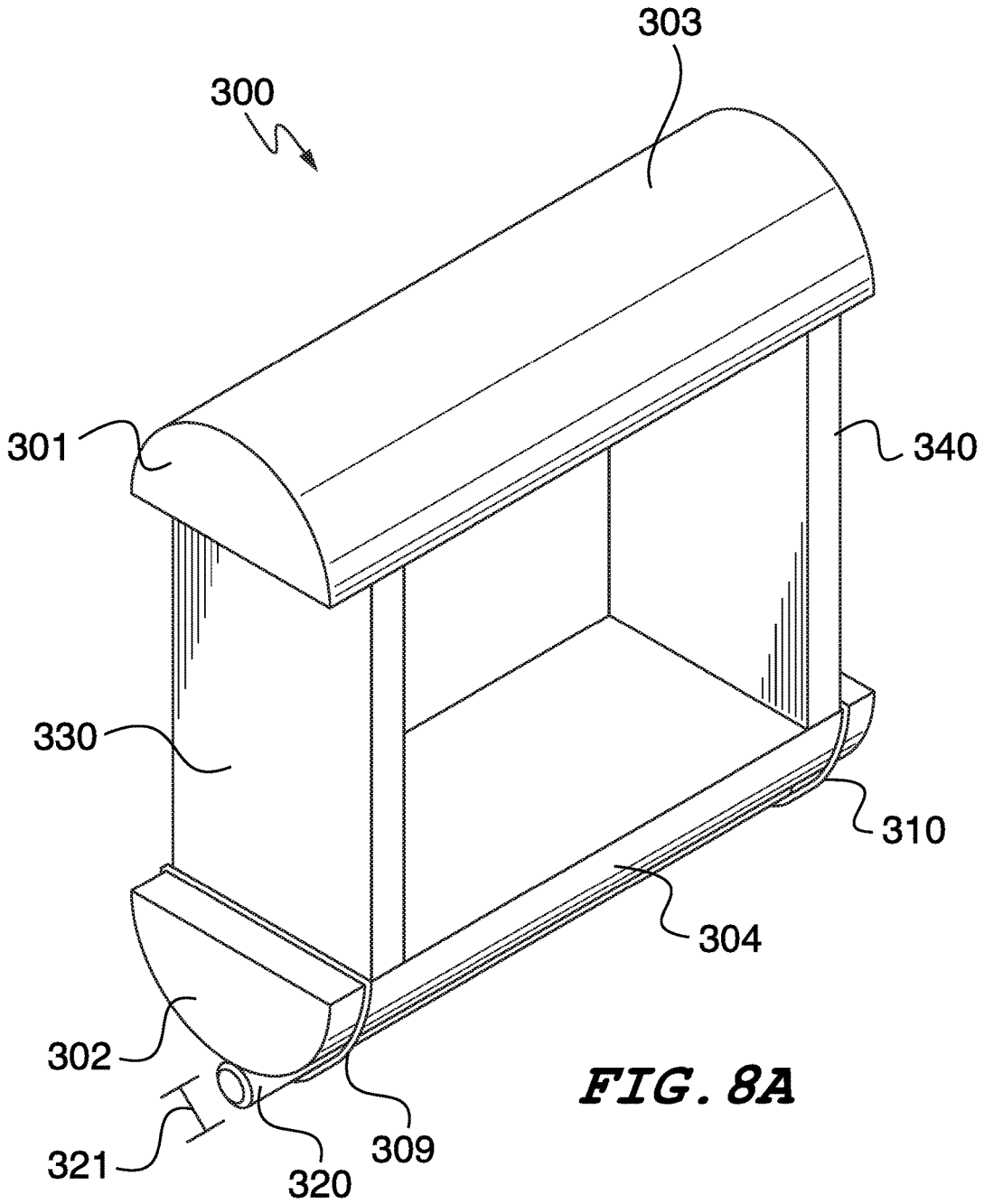
FIG. 8A is a perspective view of a fixed dimension circular loom in an embodiment of the invention.

FIG. 8A presents a perspective view of an embodiment of a circular loom having a fixed size. A circular loom can be produced of inexpensive materials having a fixed dimension. The fixed dimension loom 300 can be molded from plastic or other high throughput method to produce inexpensive products. First end member 301 comprises first smooth surface 303, second end member 302 comprises second smooth surface 304 and is configured to retain looped warp threads, not shown, and a circular woven article, not shown. The smooth surfaces 303 and 304 are configured for slidable removal of a woven article, and continuous lateral positioning of warp elements, and slidable rotation of warp elements about the circumference of the circular loom. A novel aspect of the current invention is that a woven article can be slidably removed from the circular loom. After the decorative elements, e.g. beads, are added to the entire length of the warp loops, the weft or weaving thread can be tied off and the article can be slidably removed to either side of the circular loom in FIG. 8A. Spacer 320 can be employed and retained with first spacer retaining means 309 and second spacer retaining means 310. First stanchion 330 and second stanchion 340 provide stability and spacing between first end member 301 and second end member 302. Spacer 320 can be utilized to provide easement during use. Additional embodiments can be employed where a single stanchion is utilized to space and retain first end member 301 and second end member 302. A single stanchion, not shown could be oriented along the length of the end members.

Figure 8B:
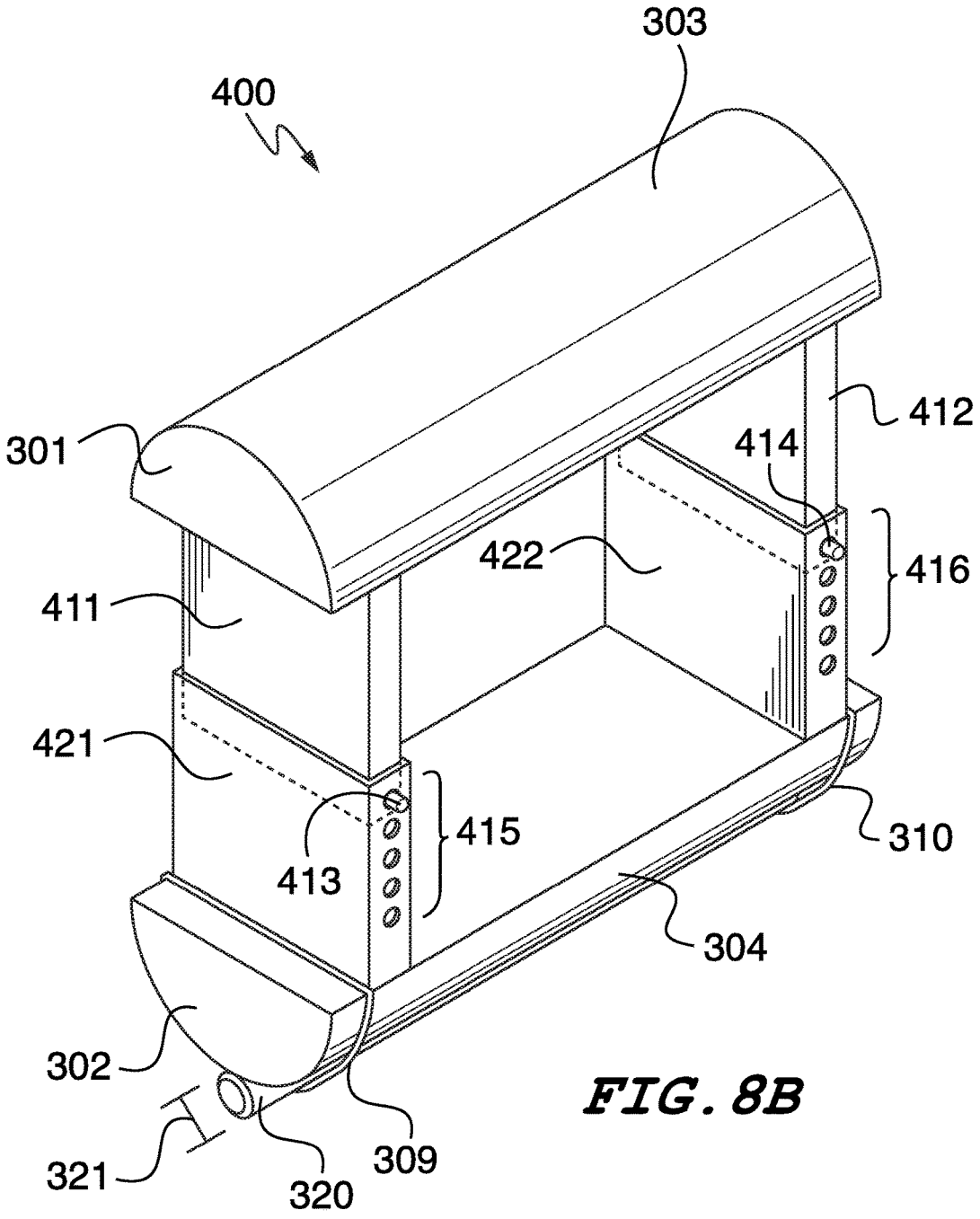
FIG. 8B is a perspective view of an adjustable circular loom in an embodiment of the invention.

FIG. 8B presents a perspective view of an embodiment of a circular loom having an adjustable size. Adjustable loom 400 is shown with a first stanchion 411 and first protrusion 413 that can be depressed into first stanchion 411 and alternately engage one of a plurality of selection recesses 415 in first receiving leg 421. Second stanchion 412 can be similarly configured with second protrusion 414 that can be positioned to engage one of a plurality of selection recesses 416 disposed in second receiving leg 422 to establish a distance between first end member 301 and second end member 302 and configure the adjustable loom 400 for producing a looped woven article, not shown, of a desired circumference. Other adjustment means can be provided to alter the distance between first end member 301 and second end member 302. Spacer 320 can be employed with spacer retaining means 309, 310 to provide easement of the woven article as elements such as beads, that have a width, are added to the woven article, not shown. Embodiments can be provided that expand from an outer circumference of seven inches to nine inches, or five inches to nine inches, or other size ranges as desired, by inserting protrusions 413 and 414 in the appropriate selection recesses 415, 416 of stanchions of various lengths. Selection recesses can be labeled to indicate the circumference of the adjustable loom created by insertion into the respective selection recess. A kit can be provided with one end member 302 comprising selection recesses and a set of first end members 301 having stanchions 411, 412 of various lengths to allow a user to assemble a circular loom having a range of circumferences.

Advantages of the circular loom as presented in the various embodiments are numerous. An embodiment of the invention can be provided that is symmetrical as shown in FIG. 2. This embodiment can be used on both sides, or upside down without consequence. Both sides of the circular loom of FIG. 2 will function in both directions allowing ease of use by both left and right handed individuals. Because the circular loom can produce a looped article, the dimensions of the loom are considerably more condensed than those of a conventional loom. To make a woven item with a circumference of 9 inches on a conventional loom, a loom of greater than 9 inches in length is required. A circular loom in an embodiment of the invention can produce a 9 inch looped woven article with a circular loom of less than four inches in length. When utilized with struts resulting in a finished loop up to 9 inches, the circular loom is compact and lightweight and may be held in one hand while the weaving is achieved with the other hand. This allows the user to sit upright while weaving and to shift or change position while continuing to weave, thus avoiding fatigue from maintaining one body position for an extended time when bending over a conventional loom, for example on a tabletop. The loom of the invention as presented in a kit embodiment can also be constructed and deconstructed quickly and easily as needed. Disassembly of the circular loom results in a compact configuration that is easily stored. Most conventional looms require a sturdy frame to tension the warp threads, and many conventional looms are not readily disassembled or may not be configured to allow disassembly by the user. Conventional looms may be bulky to carry or store. The loom of the present invention benefits from the tension of the warp elements to tension the elements of the loom together.

The loom of the current invention can be used to construct a looped woven article and the completed article can be slidably removed from the circular loom. Another article can be woven on the loom without any preparation of the end members of the loom and another woven article can be created immediately. The loom of the current invention is free of crenellations or grooves to retain warp threads, instead relying on decorative elements, such as beads, to space the warp loops apart. Because the end members comprise a smooth outer surface, the completed or partially completed woven article can be slidably removed from the circular loom without damage to the surface of the decorative elements or beads that can be caused by grooves or crenellations. The loom of the present invention can be provided with struts comprising wooden dowels. Wooden dowels can be sanded, filed, or cut to reduce their length to an exact size for an intended use, such as the wrist of a particular person. Additional wooden dowels can be economically provided. Longer struts or inner spacing can be provided to produce longer woven articles such as hat bands, head bands, belts, or woven articles.

Another advantage of the embodiments of the invention is that warp loops can be specifically spaced apart to accommodate decorative items of different sizes. Using beads as an example, a bead foundation unit can be provided with beads of different shapes and sizes. The warp loops can be constructed as shown in FIG. 6A with variable spacing between the loops as dictated by the dimensions of the decorative elements or beads. The smooth outer surface of end members shown in the figures allows infinite fine adjustments of the position of each warp element and the distance between the warp elements by continuous lateral positioning of warp elements. Smooth outer surfaces of the end members allow a circular loom to be adjustable as to warp loop spacing. The warp loops 241 to 245 in FIG. 6A can be constructed closer together or further apart to accommodate different decorative elements. The warp loops can be slidably positioned closer together or further apart, and are laterally slidable, in addition to allowing for slidable rotation of the warp loops about the circumference of the end members 2, 5. The warp circles 341 to 345 in FIG. 6B can also be adjustably located at various lateral positions to establish various spacing to accommodate various decorative elements. The warp circles of FIG. 6B are slidably positioned around first end member 2 and second end member 5. Warp circles are rotatably slidable about the circular loom. Warp circles are also laterally slidable to increase the distance between the warp circles or decrease the distance between warp circles allowing larger and smaller beads or decorative elements to be accommodated and incorporated in the same woven article.

Further, the operations described herein can be performed in any sensible order. Any operations not required for proper operation can be optional.

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. A circular loom comprising:

a first end member having a first outer surface and a first recess disposed on a first inner surface;

a second end member having a second outer surface and a second recess disposed on a second inner surface;

a first strut having a first strut length wherein a first end of said first strut engages said first recess and a second end of said first strut engages said second recess to provide internal spacing between said first end member and said second end member;

a first retaining means on said first end member configured to retain a tensioning member, and a second retaining means on said second end member configured to retain said tensioning member;

said first outer surface is smooth and said second outer surface is smooth and said outer surfaces are configured for rotational movement of a looped article around said outer surfaces; and said first end member and said second end member are configured for slidable removal of said looped article.

2. The circular loom of claim 1 further comprising:

a third recess disposed on said first inner surface of said first end member;

a fourth recess disposed on said second inner surface of said second end member;

a second strut having a second strut length wherein a first end of said second strut engages said third recess and a second end of said second strut engages said fourth recess to provide stability and internal spacing between said first end member and said second end member.

3. The circular loom of claim 2 further comprising a spacer configured for slidable engagement between at least one circular warp loop and said first outer surface, and said first outer surface comprises a semicircular cross section.

4. The circular loom of claim 3 further comprising:

a second spacer configured for slidable engagement between at least one circular warp loop and said second outer surface.

5. The circular loom of claim 1 further comprising:

a compression member engaging said first retaining means and said second retaining means thereby retaining together said first end member and said second end member.

6. The circular loom of claim 5 wherein said compression member further comprises an elastic loop.

7. The circular loom of claim 5 further comprising:

a third retaining means on said first end member configured to retain a tensioning member, a fourth retaining means on said second end member configured to retain said tensioning member, and a second compression member engaging said third retaining means and said fourth retaining means.

8. A kit for assembling a circular loom comprising:

a first end member comprising a first smooth outer surface and a first recess and at least one retaining means for receiving a compression member;

a second end member comprising a second smooth outer surface and a second recess and at least one retaining means for receiving said compression member;

a plurality of struts having different strut lengths configured to provide a variety of lengths of internal spacing between said first end member and said second end member; and at least one spacer.

9. The kit of claim 8 further comprising:

a plurality of struts having different strut lengths configured to provide said internal spacing at a variety of lengths.

10. The kit of claim 8 further comprising:

a plurality of compression members; and said first end member comprises a second retaining means and said second end member comprises a third retaining means.

11. The kit of claim 8 wherein said plurality of struts comprises at least four pairs of struts configured to construct a circular loom providing an exterior circumference from five inches to nine inches.

12. The kit of claim 8 wherein said plurality of struts comprises at least three pairs of struts configured to construct a circular loom providing an exterior circumference range of at least two inches.

13. The kit of claim 8 further comprising:

a plurality of non-latex elastic bands a case; and at least two pairs of spacers wherein each spacer is rod shaped and configured to space a warp loop apart from said first smooth outer surface, and each spacer comprises a spacer width equal to a multiple of a bead wall thickness.

14. The kit of claim 8 further comprising:

a first post recess disposed in said first end member and oriented perpendicular to said first recess; and a second post recess disposed in said second end member and oriented perpendicular to said second recess.

15. A fixed dimension circular loom comprising:

a first end member comprising a first smooth surface;

a second end member comprising a second smooth surface;

at least one stanchion affixed to said first end member and affixed to said second end member to position said first end member parallel to said second end member; and said first smooth surface and said second smooth surface are configured to provide a circumference for continuous lateral positioning of warp elements and slidable rotation of said warp elements about said circumference; and said first smooth surface and said second smooth surface are configured for slidable removal of a looped woven article.

16. An adjustable circular loom comprising:

a first end member comprising a first smooth surface;

a second end member comprising a second smooth surface;

a stanchion affixed to said first end member and comprising a protrusion;

a receiving leg affixed to said second end member and comprising a plurality of selection recesses, said receiving leg configured to receive said stanchion and said protrusion configured to engage said selection recesses to adjust said first end member relative said second end member;

said first smooth surface and said second smooth surface are configured to provide a circumference for continuous lateral positioning of warp elements and slidable rotation of said warp elements about said circumference; and said first smooth surface and said second smooth surface are configured for slidable removal of a looped woven article.

17. A method for constructing a looped woven article comprising the step of:

providing a circular loom;

establishing a plurality of warp loops around a first end member and a second end member of said circular loom;

weaving a decorative item to said plurality of warp loops by passing a warp thread through said decorative item and behind said plurality of warp loops and again above said plurality of warp loops;

and weaving additional decorative items to said plurality of warp loops to produce a looped woven article; and slidably removing said looped woven article from said circular loom.

18. The method of claim 17 wherein the step of providing a circular loom comprises providing a circular loom wherein said first end member is spaced apart from said second end member by at least one removable strut.

19. The method of claim 17 wherein the step of providing a circular loom comprises a fixed dimension circular loom.

20. The method of claim 17 wherein the step of providing a circular loom comprises a adjustable circular loom comprising a stanchion and receiving leg.

* * * * *